US006543775B1

(12) United States Patent
Bell, Jr.

(10) Patent No.: US 6,543,775 B1
(45) Date of Patent: Apr. 8, 2003

(54) TAGBALL GAME

(76) Inventor: Phillip Bell, Jr., 5635 River Rd., Bryan Road, MD (US) 20616

( * ) Notice: Subject to any disclaimer, the term of this patent is extended or adjusted under 35 U.S.C. 154(b) by 0 days.

(21) Appl. No.: 09/845,068

(22) Filed: Apr. 30, 2001

Related U.S. Application Data

(63) Continuation-in-part of application No. 09/363,661, filed on Jul. 15, 1999, now abandoned.

(51) Int. Cl.[7] ..... A63B 67/00
(52) U.S. Cl. ..... 273/348.4; 273/DIG. 30
(58) Field of Search ..... 273/348.4, DIG. 30; 124/56; 473/573, 469, 600

(56) References Cited

U.S. PATENT DOCUMENTS 4,718,677 A * 1/1988 Barnes ..... 273/348.4
4,971,334 A * 11/1990 Stewart ..... 273/348.4
4,986,548 A * 1/1991 Conner ..... 273/348.4
5,082,291 A * 1/1992 Appel et al. ..... 273/348.4
5,221,092 A * 6/1993 Simons et al. ..... 124/1
5,373,582 A * 12/1994 Dragone et al. ..... 2/2.5
5,845,629 A * 12/1998 Ratliff ..... 124/56
5,868,637 A * 2/1999 Poxon ..... 473/469
5,967,916 A * 10/1999 Robeson ..... 473/600

* cited by examiner

*Primary Examiner*—Raleigh W. Chiu

(57) ABSTRACT

The present invention includes a method and apparatus for playing a ball game and the associated vest. The method includes: dividing the players into two teams; providing a vest for each of the players, with the external surface of the vest being provided with a pile-type surface and bull's-eyes; providing a plurality of objects with a pile-type surface; awarding points to the player striking the opposing player and removing the struck player from the game; providing a quantity of flags to be protected by one team and taken by the other team; dividing the play of game into three periods; and counting the flags acquired and points scored through the throwing of the objects.

1 Claim, 5 Drawing Sheets

56
58

26
68
62
64
60

TAGBALL GAME

RELATED APPLICATION

This application is a continuation-in-part of application Ser. No. 09/363,661 filed Jul. 15, 1999 to Phillip Bell, Jr. now abandoned.

BACKGROUND OF THE INVENTION

1. Field of the Invention

The present invention relates to a tagball game and more particularly pertains to a method and apparatus of playing a tagball game.

2. Description of the Prior Art

The use of games is known in the prior art. More specifically, games previously devised and utilized for the purpose of playing are known to consist basically of familiar, expected, and obvious structural configurations, notwithstanding the myriad of designs encompassed by the crowded prior art which has been developed for the fulfillment of countless objectives and requirements.

While the known games fulfill their respective, particular objectives and requirements, the aforementioned patents do not describe a method of playing a tagball game as disclosed herein.

In this respect, the tagball game method and apparatus according to the present invention substantially departs from the conventional concepts and designs of the prior art, and in doing so provides a method and apparatus primarily developed for the purpose of playing a new tagball game.

Therefore, it can be appreciated that there exists a continuing need for new games which can be used for playing. In this regard, the present invention substantially fulfills this need.

SUMMARY OF THE INVENTION

In view of the foregoing disadvantages inherent in the known types of games now present in the prior art, the present invention provides an improved tagball game method and apparatus. As such, the general purpose of the present invention, which will be described subsequently in greater detail, is to provide a game method and apparatus which has all the advantages of the prior art and none of the disadvantages.

To attain this, the present invention essentially comprises a method and apparatus for playing a game. The first step in the method is dividing the players into two teams with 2 or more players, preferably about 7 and generally no more than 35 players per team. The method further includes providing a vest for each of the players. Each team has a distinguishing color vest. The external surface of the vest has a pile-type surface. Bull's-eyes are provided on the front and back of the vest. Numerical values are provided on the bull's-eyes. The method also includes a plurality of objects to be projected from one player toward a bull's-eye of a player on the opposite team. The objects are provided with a pile-type surface. In this manner, if the object strikes a bull's-eye, the object is retained on the vest by means of the pile-type surface. The method includes awarding 5 points to the player striking the target of an opposing player in a bull's-eye area. The player is removed from the game for the reminder of the period if a bull's-eye on his vest has been struck. The method further includes awarding 1 point to the player striking the vest of an opposing player in an area other than the bull's-eye area. The player is removed from the game for 2 minutes if an area on his vest other than the bull's-eye area is struck. The method includes providing a quantity of flags. The flags are to be protected by one team. The flags are to be taken by the opposite team. The method also includes dividing the play of game into three periods. Each period is between about 10 and 15 minutes in length. Each subsequent period is shorter than the first. The time between periods is shorter than the time between prior periods. Players throw their objects and capture flags until the time period has elapsed. Finally, the method includes counting the flags acquired and points scored through the throwing of the objects. If one team wins the first and second periods, they have won the game and a third period is not played.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a method and apparatus of playing a tagball game which has all of the advantages of the prior art games and none of the disadvantages.

It is another object of the present invention to provide a method and apparatus of playing a tagball game which may be easily and efficiently manufactured and marketed and played.

An even further object of the present invention is to provide a tagball game method which is susceptible of a low cost of manufacture with regard to both materials and labor, and which accordingly is then susceptible of low prices of sale to the consuming public, thereby making such tagball game economically available to the buying public.

Lastly, it is an object of the present invention to provide a method and apparatus for playing a ball game and the associated vest. The method includes dividing the players into two teams; providing a vest for each of the players, with the external surface of the vest being provided with a pile-type surface and with a bull's-eye; providing a pile-type surface on a plurality of objects to be projected; taking players out of the game and awarding points for players struck; providing a quantity of flags to be protected by one team and to be taken by the opposite team; dividing the play of game into three periods; and counting the flags acquired and points scored through the throwing of the objects.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

DESCRIPTION OF THE PREFERRED EMBODIMENT

Figure 1:
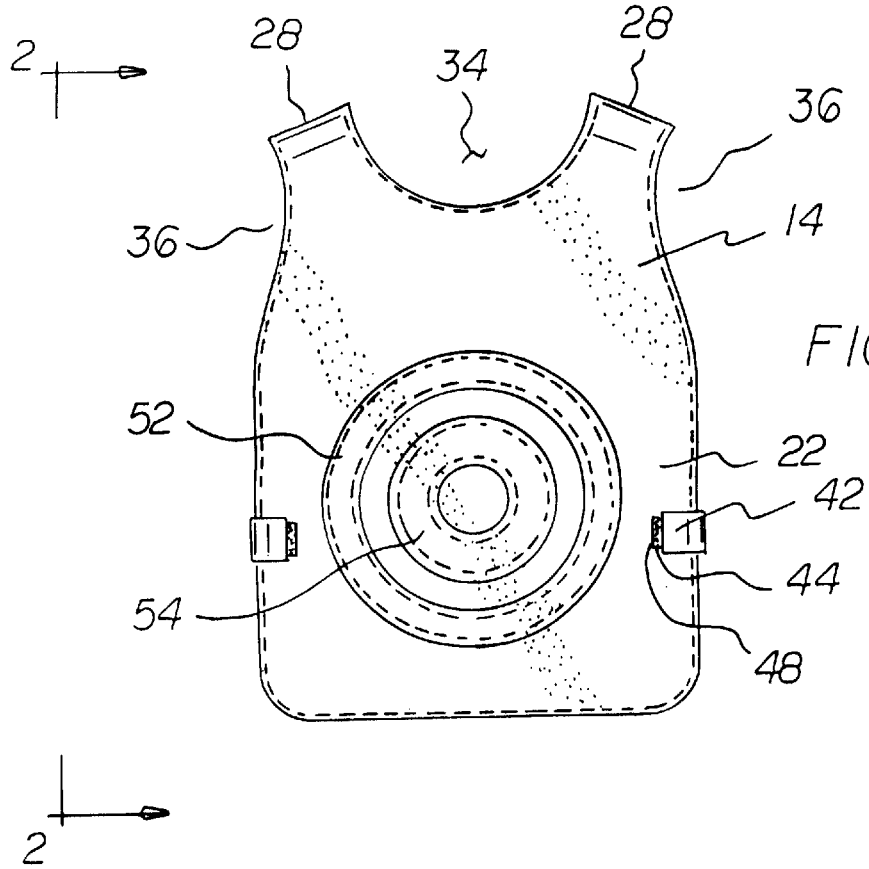
FIG. 1 is a front view of the vest of the present invention.
Figure 2:
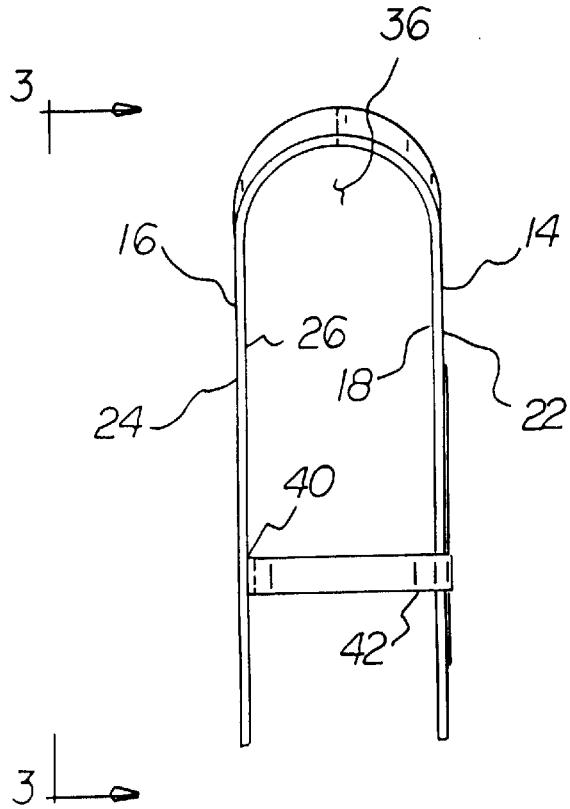
FIG. 2 is a side view of the vest of the present invention.

The present invention involves a tagball vest and other apparel. A tagball vest 12 is adapted to be used during a game of tagball. The tagball vest comprises a pair of torso-shaped pieces of fabric 14, 16. The pieces of fabric form a front portion 14 and back portion 16. Each portion has an inside face 18, 20 and an outside face 22, 24. The pieces of Fabric are made of a heavy felt material of a first color. All the edges of the fabric are preferably serged. The edges could also be unfinished or hemmed. The torso-shaped pieces are adapted to receive a pile-type fastener covered object 26 utilized in a game of tagball. Each torso-shaped piece has a pair of shoulder extensions 28. The shoulder extension of the associated front and back portions are sewn together with a serged seam 30. In this manner a pair of shoulder straps 32, a head opening 34 and a pair of side openings 36 are formed.

The tagball vest is also comprised of a pair of side straps. The side straps are of an elastomeric material. The side straps have a first end 40 and second end 42. The first end is sewn to the inside face of the back portion. Sewn to the second end is a pile-type fastener 44.

Next, the tagball vest has a second pile-type fastener 48. The second pile-type fastener is sewn to the outside face of the front portion. The second pile-type fastener is adapted to receive the pile-type fastener of the strap enabling it to be coupled to a user and be adapted to accommodate different sized users.

Figure 3:
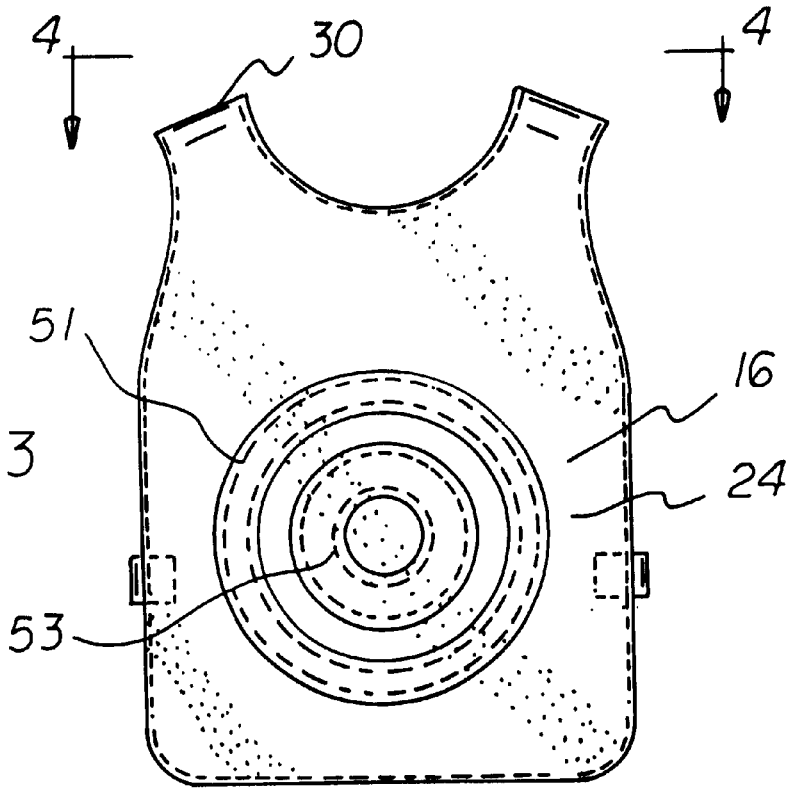
FIG. 3 is a back view of the vest of the present invention.
Figure 4:
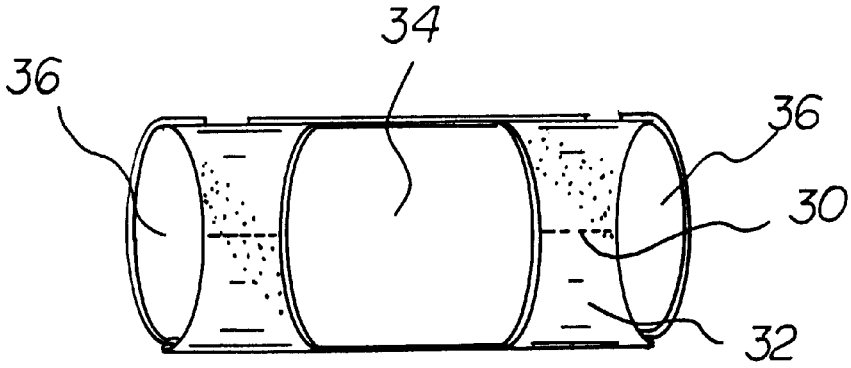
FIG. 4 is a top view of the vest of the present invention.

Finally, the tagball vest includes two rings 52, 54 of fabric on the front portion and two similar rings of fabric on the back portion 51, 53. These rings are of a second color. The rings are centered on the outside face of the front portion and the back portion. The preferred method of attachment is sewing. Each ring has an inner circumference and an outer circumference. Each ring has the same distance between the inner circumference and the outer circumference. The first ring 51, 52 is larger than the second ring 53, 54. The rings are positioned to form a bull's-eye as illustrated in FIGS. 1 and 3.

Figures 5, 6:
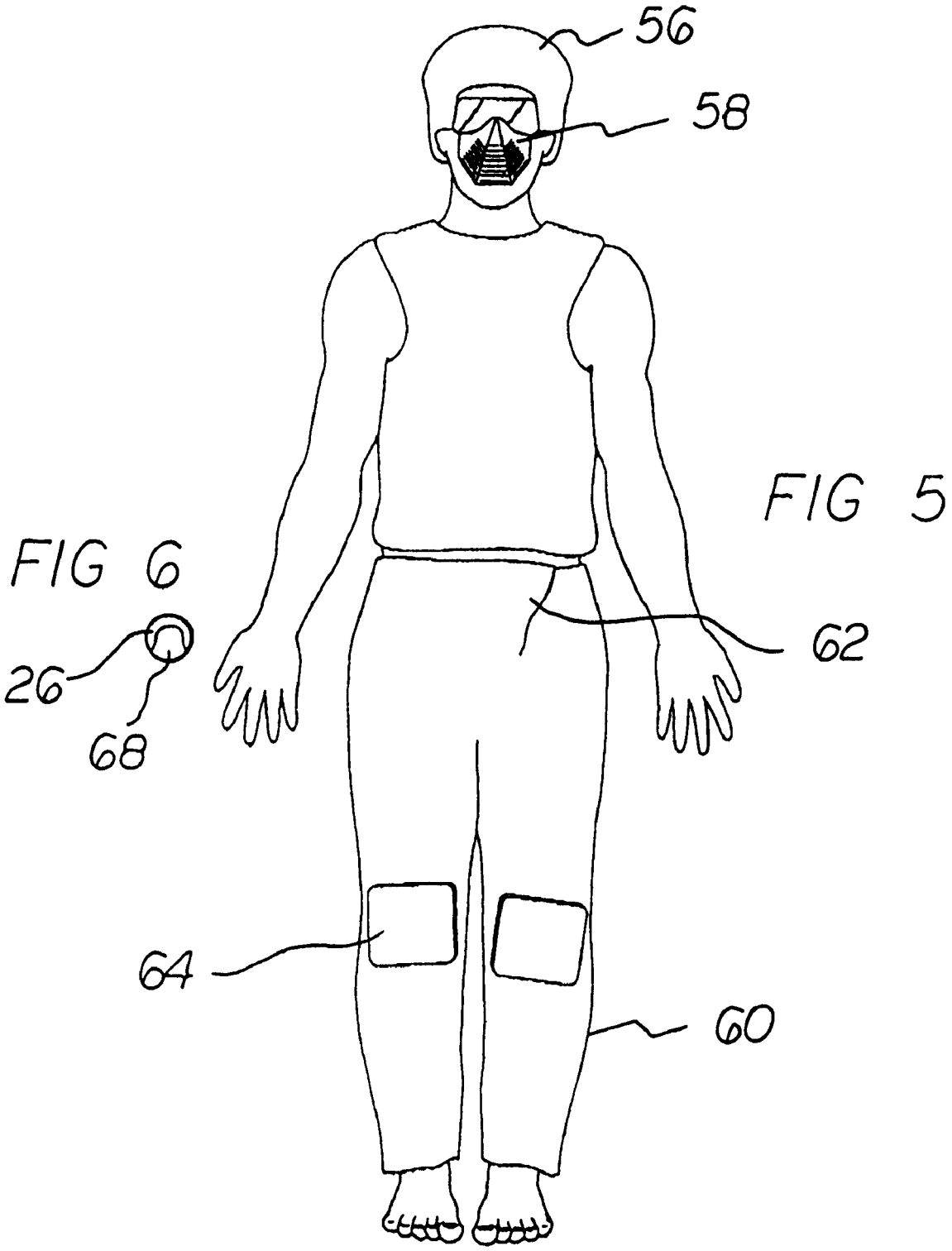
FIG. 5 is an illustration of additional apparel associated with the present invention.
FIG. 6 is an illustration of a bean bag ball used with the present invention.
Figure 7:
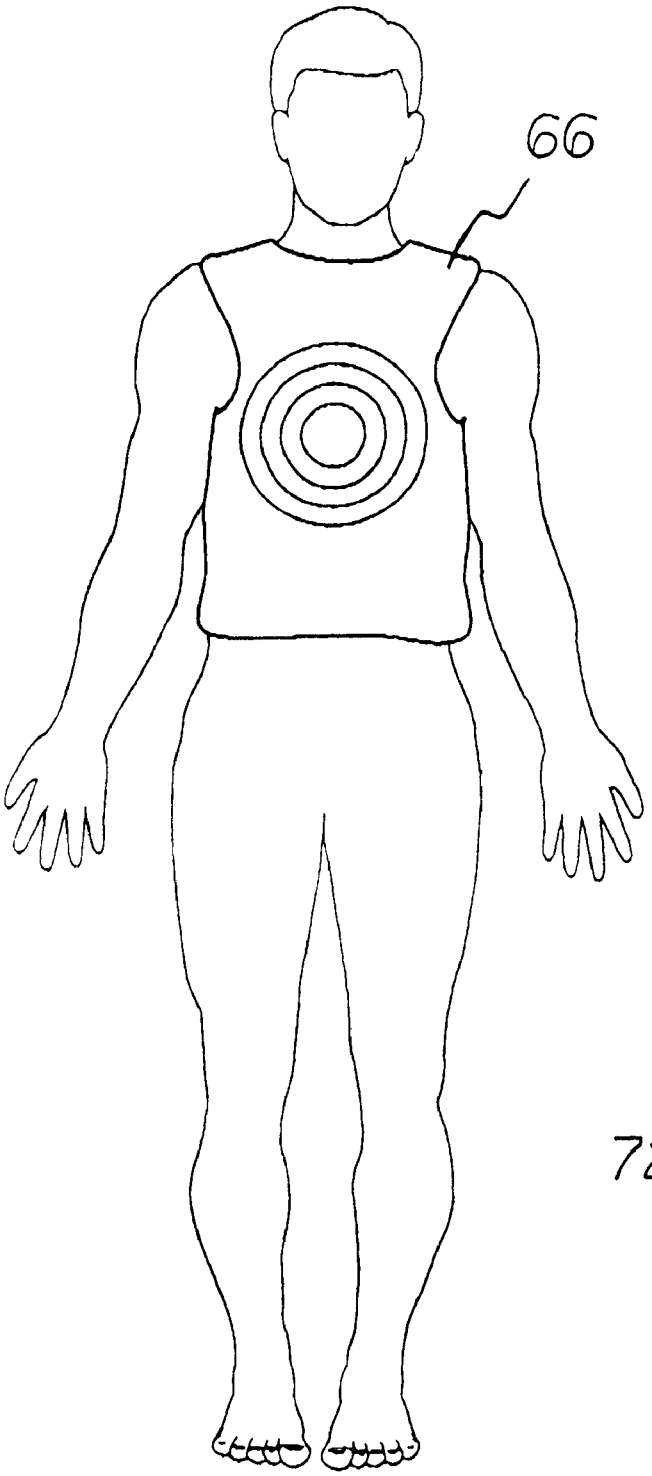
FIG. 7 is an illustration of a player wearing the vest of the present invention.

Other apparel shown in FIG. 5 includes foam head gear 56 and a face shield 58. The head gear and face shield protect a user's head and face during the game. Pants 60 are also included. The pants are of the same material as the vest. The pants also have a pile-type flap 62 making the pants adjustable. The pants have padding 64 in the knee, hip and rear regions to further protect the player.

In an alternate embodiment of the present invention, the shoulder extensions of the front and back portions of the vest are coupled by second pile-type strips 66. In this manner the vest may be more easily put on and removed.

Figure 8:
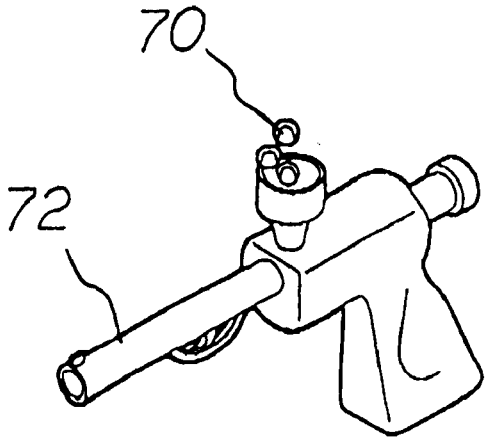
FIG. 8 is an illustration of a $CO_2$ powered gun used in an alternate embodiment of the present invention.
Figure 9:
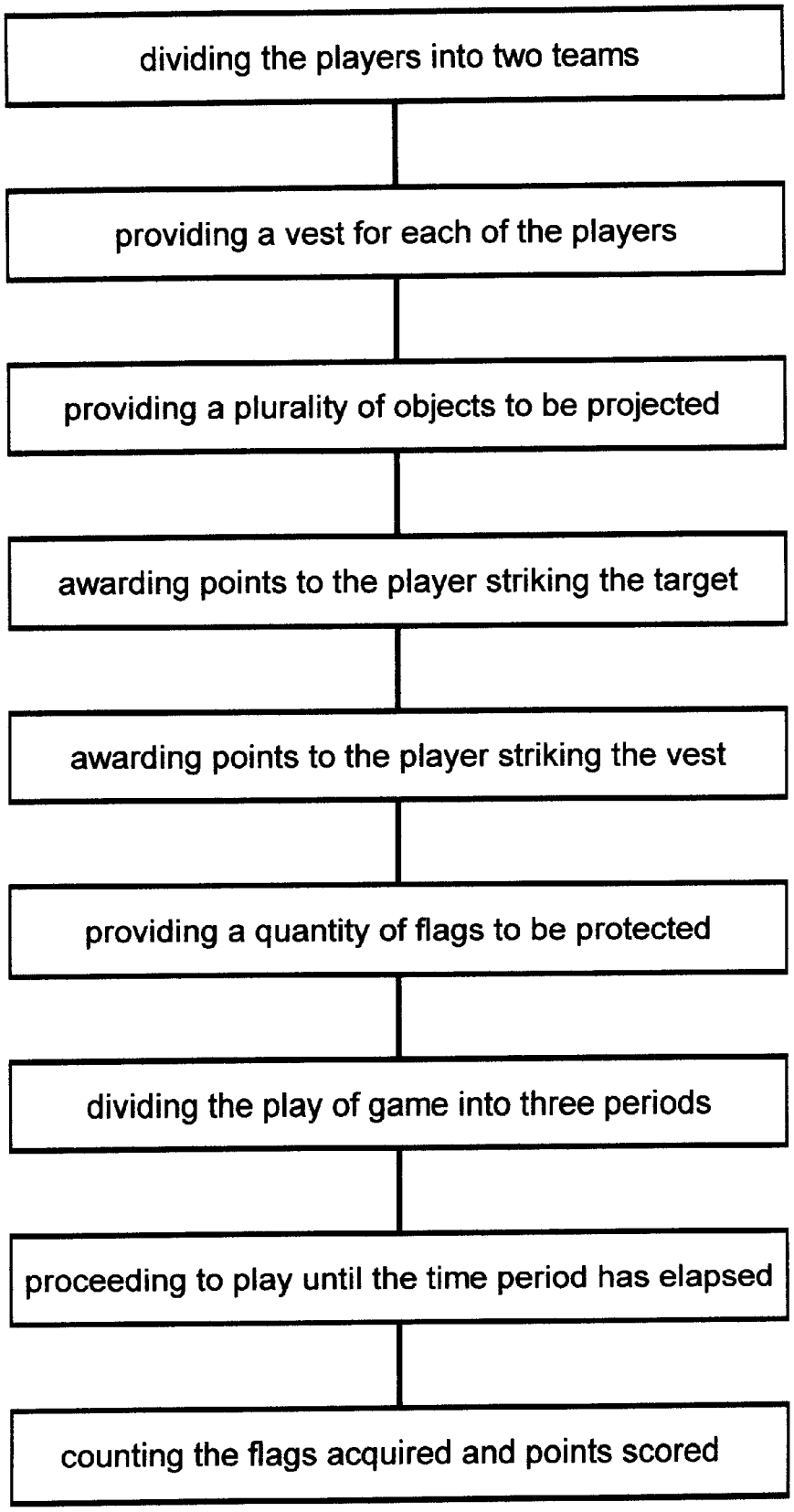
FIG. 9 is a flow chart showing the steps of the method of the invention.

The object may be of many shapes and sizes. One example is a pile-type surface covered bean bag ball 68 as illustrated in FIG. 6. Another example is pile-type surface covered bullets 70 adapted to be shot from a $CO_2$ powered gum 72 as illustrated in FIG. 8.

The present invention also includes a tagball game method which is a combination of two popular games, "capture the flag" and darts. Players have the option of wearing vests or suits with pile-type surface areas that indicate various point values. Players have the option of using pile-type covered objects, preferably balls or bean bags 68. Another option is the use of pile-type surface covered pellets or bullets 70 which can be fired from a $CO_2$ powered gun 72. The vests or suits worn in the game have a circular pattern 52 on the front with an area at the center, a bull's-eye, known as the kill zone. Striking a player in this area eliminates him from the period of the game and earns 5 points. Striking a player on any other area of the vest or suit earns the striking player 1 point and the struck player is removed from the game for 2 minutes. Tagball is divided into three periods, each lasting between about 10 and 15 minutes. Vests or suits used in tagball are made of pile-type material.

The game of the present invention is an organized team sport that combines the popular games of "capture the flag" and darts. It is designed as a fast paced exhilarating sport that promotes team building as well as physical fitness. Tagball can be played almost anywhere, by persons of any age, gender, or skill level. While providing the same adrenalin rush as paintball, tagball's optional features allow the game to be played without the legal restrictions of fire arm simulations. Tagball can be easily modified to suit those who prefer a more military war game version, or those who prefer playground fun with backyard friends, family or schoolmates.

Regarding equipment, players have the option of wearing pile-type adherent "scoring vest/suits". The objects used are pile-type surface covered and can be thrown or fired from a $CO_2$ powered cartridge gun. The pile-type bullet is softer than a paintball pellet, lessening the potential for injury or property damage. The "scoring vests/suits" include a circular pattern twelve inches in diameter on the front and/or back, similar to that of a dart board. Areas on this circular pattern and other areas of the suit have various point values.

Regarding the rules, the game is divided into three periods. Each period lasts between about 10 and 15 minutes. Two timeouts are allowed per period. A 10-minute break is allowed between the first and second periods, and a 5-minute break is allowed between the second and third periods. If the number of players on each team exceeds ten, two flags should be used per team along with two flag goalies. The center of the pattern on the front and/or back of the vest/suit is known as the kill zone. If a player is struck in this zone, he must sit out for the remainder of the period and the striking player earns 5 points. If a player is struck in another area, one point is earned and the struck player must sit out the game for 2 minutes. The team capturing the most flags in two periods wins. If no flags are captured, the game will be won by the team scoring the most points.

Tagball is a poor man's war game where players wear specially made pile-type adherent uniforms and/or vests. Pile-type covered balls are thrown to "tag" players on the opposing team. The object of the game is to win by capturing the other team's flag. Players who are struck by a ball that attaches to their kill zone area on the vest or uniforms are eliminated from the period of the game. Only a "live" player can capture a team's flag. The game should be played in three 10 to 15-minute periods. The team that captures the flag two out of three periods, the team having the least eliminated players in two periods, or the team with the greatest amount of points wins. There should be between about 7 and 35 players on each team and between about 2 and 3 referees.

Players should wear special uniforms/vests equipped with padding. Arm and knee pads should be worn, especially when playing in wooded areas. Other apparel, cushioned karate-type head gear and face shields should also be worn. The objects used in the game are pile-type covered balls or pile-type covered bean bags.

As can be understood from the foregoing, tagball is a new game presented as an organized team sport. Tagball/bag is a poor man's war game which combines the game of "caoture the flag" and the dart board/tag concept. The object of the game is to avoid being hit by the opposite team's objects before capturing the opposite team's flag within a time limit of 2 to 3 periods. A third period is only necessary when a team falls to stop the opposing team from capturing the flag in the first two 15-minute periods of the game. Between the first two periods, a 7-minute break and strategy session occurs. Between the second and third periods, a 5-minute break occurs. If a flag has not been captured by the end of the third period, victory goes to the team having eliminated more opposing members. The game needs about 2 to 4 overseeing officials or referees.

Another form of the game is tagball/bag featuring two opposing teams made up of between about 7 and 10 players. Players wear vests/uniforms featuring pile-type adherent bull's-eye targets on the fronts of their vests. Older youth and adult players throw pile-type adherent, tennis ball sized bean bag balls. A pile-type adherent bean bag is used by very young children. The apparatus used for playing the game consists of essentially a pile-type adherent bull's-eye vest and a pile-type adherent ball or bean bag.

The object of this fast paced, exhilarating sport is to promote team building, physical fitness, eye hand coordination, and provide a non-injurious alternative contact sport for all ages and both genders. The game can be played as a basic elimination game in the woods, outdoor playing fields, with obstacles, in gyms, multipurpose rooms, tennis or basketball courts. Tagball/bag can be played almost anywhere by anyone.

While providing the same adrenalin rush as football and paintball, tagball/bag's optional features allow the game to be played without the legal, environmental, or economic limitations that may be incurred with paintball or football. The likelihood of injury is also reduced.

Tagball/bag can be easily modified to suit those who prefer a more military war game version, football play experience or for an indoor activity in a gymnasium. However, tagbag, for the younger children, can be played in a multipurpose room, and/or backyard with family, friends or schoolmates.

From the descriptions herein above of the method of playing the tagball game of the present invention, it can be appreciated that:

1. Tagball/bag is an organized team sport which is a combination of the popular games "capture the flag", darts and tag.

2. Tagball/bag promotes team building as well as physical fitness.

3. Depending on age, players have the option of using pile-type surface covered balls or bean bags.

4. Tagball/bag is a dynamic, fast paced, and exhilarating dart board game with a tag concept.

5. There are two ways to win in tagball/bag: eliminating a player by striking a bull's-eye target, or kill zone, on the player's vest or accumulating the greatest number of points.

6. Tagball/bag can be played in three 15-minute periods or as an unlimited time activity.

7. Tagball/bag vest or suits could be made of plastic and used in a traditional paintball game.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art. it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method for playing a tagball game comprising, in combination:

dividing the players into two teams with between about 7 and 35 players per team;

providing a vest for each of the players, each team having a distinguishing color vest with the external surface of the vest being provided with a pile-type surface and with bull's-eyes on front and back with numerical values;

providing a plurality of objects to be projected from one player toward a bull's-eyes of a player of the opposite team, the object being provided with a pile-type surface for being retained on a bull's-eye if a bull's-eye is hit;

awarding points to the player striking the target of an opposing player in a bull's-eye area and removing the struck player from the period of the game if hit in a bull's-eye;

awarding points to the player striking the vest of a player in an area other than the bull's-eye area and removing the struck player from the game for 2 minutes;

providing a quantity of flags to be protected by one team and to be taken by the other team;

dividing the play of game into three periods, each period being between about 10 and 15 minutes in length with each subsequent period being shorter than the first and the time between periods being shorter than the one there before;

proceeding to play with players throwing their objects and capturing flags until the time period has elapsed; and counting the flags acquired and points scored through the throwing of the objects.

* * * * *